US005991985A

United States Patent [19]

Galbreath

[11] Patent Number: 5,991,985

[45] Date of Patent: Nov. 30, 1999

[54] SAFETY SNAP BUCKLE

[76] Inventor: John Alexander Galbreath, Reisterstown, Md.

[21] Appl. No.: 09/127,135

[22] Filed: Jul. 31, 1998

[51] Int. Cl.[6] ..... A44B 11/25

[52] U.S. Cl. ..... 24/625

[58] Field of Search ..... 24/614–625

[56] References Cited

U.S. PATENT DOCUMENTS

| | | | |
|---|---|---|---|
| 4,150,464 | 4/1979 | Tracy | 24/77 R |
| 4,569,106 | 2/1986 | Lovato | 24/615 |
| 4,672,725 | 6/1987 | Kasai | 24/625 |
| 4,688,337 | 8/1987 | Dillner et al. | 24/616 |
| 4,793,032 | 12/1988 | Crowle | 24/615 |
| 4,825,515 | 5/1989 | Wolterstorff, Jr. | 24/625 |
| 4,912,950 | 4/1990 | Crowle | 70/58 |
| 4,987,661 | 1/1991 | Kasai | 24/625 |
| 5,131,122 | 7/1992 | Lovato | 24/625 |
| 5,144,725 | 9/1992 | Krauss | 24/625 |
| 5,291,641 | 3/1994 | Morino | 24/625 |
| 5,438,737 | 8/1995 | Anscher | 24/630 |
| 5,459,910 | 10/1995 | Ancher | 24/625 |
| 5,774,959 | 7/1998 | French et al. | 24/625 |

*Primary Examiner*—James R. Brittain

[57] ABSTRACT

The device is a snap buckle with a safety feature—an additional catch which prevents the buckle from being inadvertently disengaged. A male plug, having side catch arms and a central member with an additional catch, forms one part of the device. A female socket having a depressible member forms the other part of the device. To engage, plug and socket are urged together until the side catch arms, and the additional catch on the central member, both engage the socket. To disengage, the depressible member is depressed to disengage the additional catch on the central member, while simultaneously the side catch arms are depressed to disengage them from the socket.

17 Claims, 6 Drawing Sheets

SAFETY SNAP BUCKLE

CROSS-REFERENCES TO RELATED APPLICATIONS

Not Applicable

BACKGROUND OF THE INVENTION

1. Field of the Invention

This invention is in the area of snap buckles, specifically a snap buckle with a safety feature that prevents inadvertent or unwanted release.

2. Description of the Related Art

Snap buckles are known in the art, beginning with U.S. Pat. No. 4,150,464 to Tracy. Variations on this buckle type include U.S. Pat. Nos. 4,569,106 to Lovato; 4,672,725 to Kasai; 4,688,337 to Dillner and Smous; 4,987,661 to Kasai; 5,131,122 to Lovato; 5,291,641 to Morino; and 5,438,737 and 5,459,910, both to Anscher.

All these prior art devices have a male plug member with one or two side catch arms, and a female socket member. When the male plug is inserted into the female socket, the catch arms engage openings in each side of the female socket, locking the male plug and female socket together. Disengagement is effected by pushing in the portions of the catch arms that protrude through the openings in the female socket.

Very few variations on the snap buckle incorporate an additional safety feature to prevent inadvertent or unwanted disengagement of the buckle. The very nature of the snap buckle design makes it easy to disengage, and so an additional safety feature is important in situations where the buckle may be inadvertently disengaged, or where young children may try to disengage the buckle and put themselves at risk of injury. For example, snap buckles are often used to join child restraining straps in grocery carts and strollers. Inadvertent or deliberate disengagement by a young child is inconvenient at best, and at worst can be dangerous.

Two basic approaches have been taken in the prior art to incorporating an additional safety feature into a snap buckle:

The first approach, shown in U.S. Pat. Nos. 4,793,032 to Crowle, 4,825,515 to Wolterstorff, Jr., and 5,774,956 to French and Wigger, employs an additional catch to supplement either one or two side catch arms. The additional catch is incorporated into the male plug member and is accessible directly through an opening in the top of the female socket member. The catch arms and the additional catch are operated on simultaneously to disengage the male plug from the female socket.

A major disadvantage of the above devices, however, is that the additional catch cannot be easily disengaged, even when an adult may want to do so. For example, the additional catches of U.S. Pat. Nos. 4,793,032 and 5,774,956 must be fully depressed into the interior of the female socket to clear the socket and allow disengagement. The top socket opening cannot be made large enough to enable the catch to be easily disengaged by hand, since the catch's size (and thus the opening's size) is limited by the need to provide clearance to depress the side catch arms.

A further disadvantage is that in the engagement process, the additional catch must be depressed to enter the female socket, making engagement more difficult. The additional catch cannot protrude suitably out of the top socket opening (desirable for visibility and intuitiveness of operation), since the further it protrudes, the more difficult it is to engage and disengage the catch.

The additional catch shown in U.S. Pat. No. 4,825,515 is also cumbersome to disengage. It is not centrally located on the female socket, making it less visible and less intuitive to operate.

The second approach to incorporating a safety feature into a snap buckle entails blocking the action of the side catch arms, thus preventing disengagement of the buckle. U.S. Pat. Nos. 4,912,950 to Crowle and 5,144,725 to Krauss employ locking assemblies within the female socket, which rotate to block the action of the side catch arms. The sockets of these devices are complex, entail multiple parts, and are difficult to manufacture in one piece. Further, it is difficult to manually unlock the side catch arms—it is best done with a screwdriver or other key-type tool. This is more involved and less intuitive than, say, simply pushing a button to disengage an additional catch body.

Thus it can be seen that a snap buckle with a safety feature that is difficult for a young child to operate simultaneously with the side catch arms, yet easier and more intuitive for an adult to operate than prior art, would be a significant improvement.

Accordingly, several objects and advantages of my invention are:

It is difficult for a small child to comprehend and operate. The button on the top of the female socket must be pushed down at the same time as the side catch arms are pushed in. Moreover, it is easier and more intuitive for an adult to operate than prior art devices. The button which is depressed to disengage the additional catch can be made suitably large—since it is part of the female socket, and not part of the male plug, its size is not as limited by the need to allow clearance for the action of the side catch arms. This aids visibility and intuitiveness of adult operation.

In addition, engagement of the additional catch is automatic—the additional catch need not be depressed to enter the female socket, unlike the aforementioned prior art. Lastly, the female socket can be manufactured in one piece, thereby minimizing manufacturing steps and cost, unlike those prior art devices which use rotating locking assemblies.

Further objects and advantages of my invention will become apparent from a consideration of the drawings and ensuing description.

SUMMARY OF THE INVENTION

My invention is a snap buckle with a safety feature—an additional catch—which prevents the buckle from being inadvertently disengaged. An adult can engage and disengage the additional catch more easily than prior art.

DETAILED DESCRIPTION OF THE INVENTION

Figure 1:
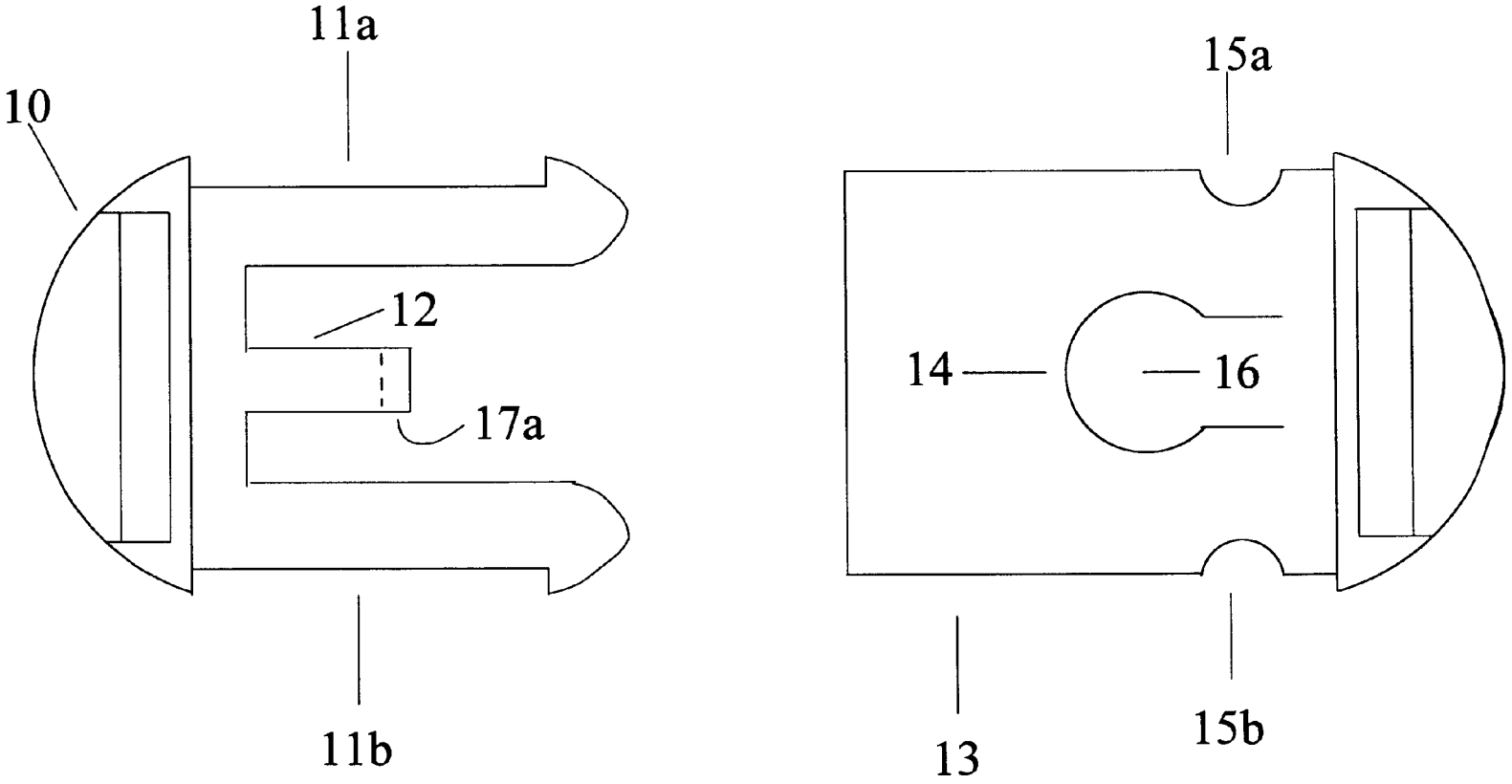
FIG. 1 illustrates the male plug and female socket, prior to insertion of the plug into the socket.
Figure 2:
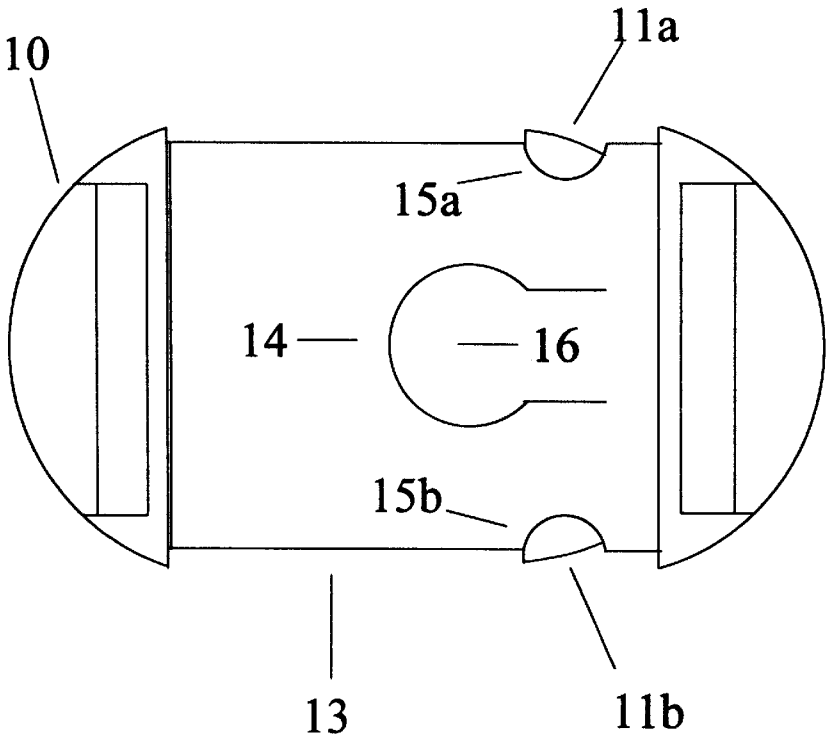
FIG. 2 illustrates the buckle in a closed, engaged position.
Figure 3:
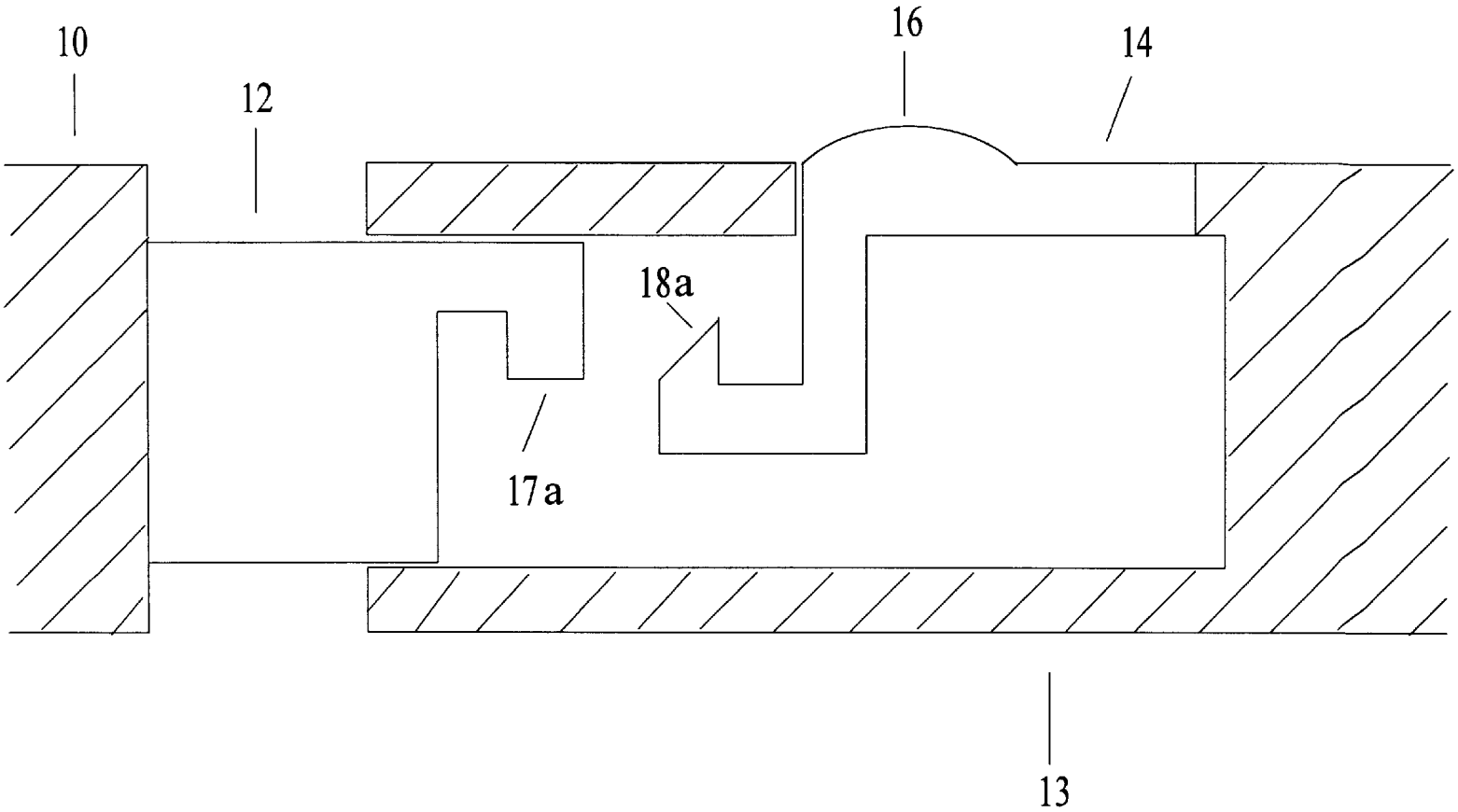
FIG. 3 provides detail on the central member and depressible member catches, just prior to engagement.
Figure 4:
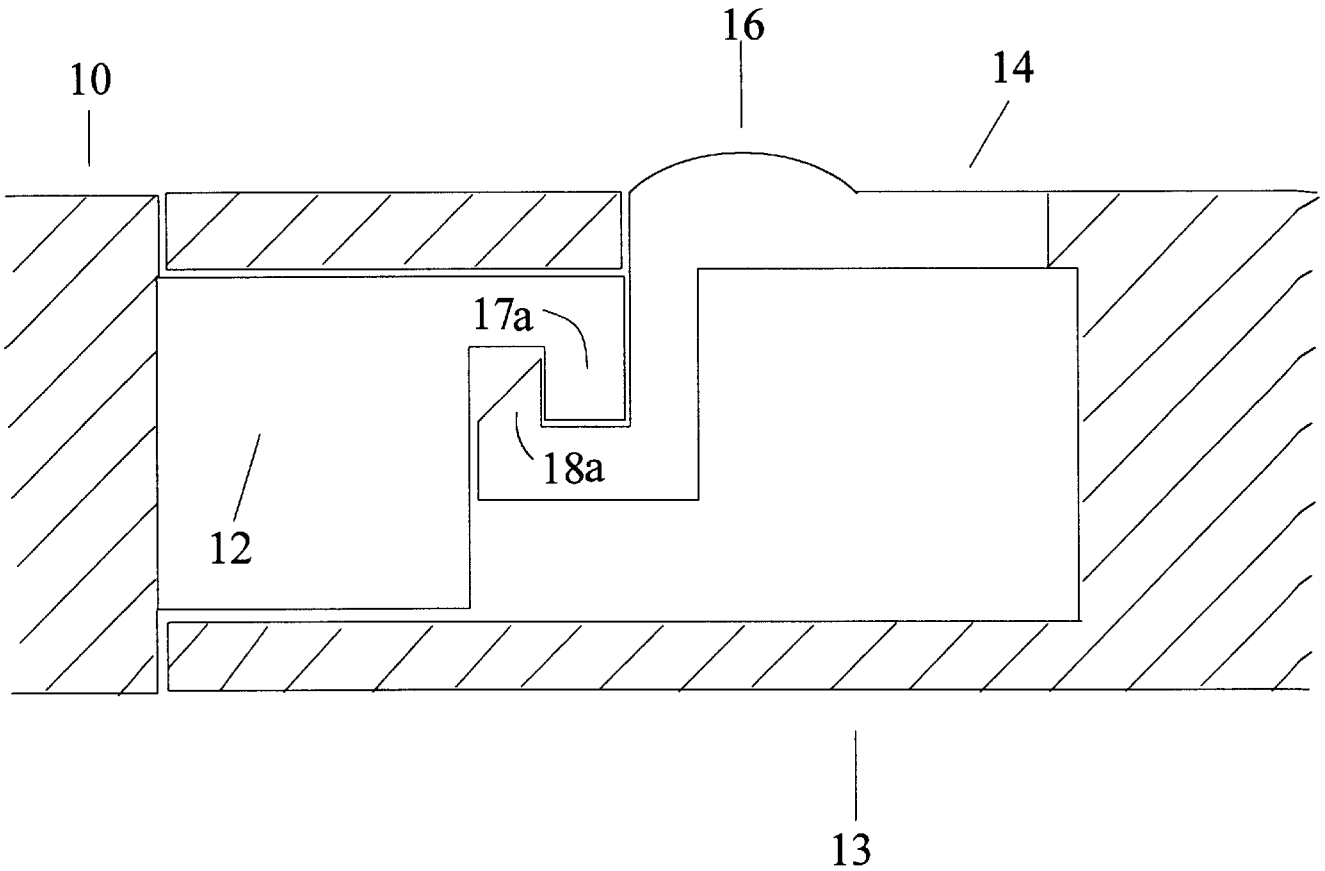
FIG. 4 provides detail on the central member and depressible member catches, after engagement.

The following provides a list of the reference characters used in the drawings:

10. Plug
11*a*&*b*. Side catch arms
12. Central member
13. Socket
14. Depressible member
15*a*&*b*. Openings
16. Button
17*a,b,*&*c*. Central member catches
18*a*&*b* Depressible member catches
19. Socket catch FIG. 1 is a top view of my invention. A male plug 10 forms one part of the device. Said plug 10 has two resilient side catch arms 11*a*&*b*, and a central member 12. A catch 17*a*, having a square-shaped cross section, is located on the projecting end of central member 12.

A female socket 13 forms the other part of the device. Two openings 15*a*&*b* are located on the sides of socket 13. A resilient depressible member 14 forms an integral part of the front surface of socket 13, and extends along the lengthwise dimension of socket 13. Depressible member 14 also projects downward into the interior of socket 13. A catch 18*a*, having a wedge-shaped cross section, is located on the socket-interior end of depressible member 14. A button 16 is located on the outer surface of depressible member 14.

To engage the device, plug 10 is inserted into the open end of socket 13, and said plug and socket are urged together until side catch arms 11*a*&*b* engage openings 15*a*&*b*, and catch 17*a* on central member 12 engages catch 18*a* on depressible member 14.

To disengage, depressible member 14 is depressed at button 16, disengaging catch 18*a* from catch 17*a*. Simultaneously, side catch arms 11*a*&*b* are pushed inward toward the interior of socket 13, allowing said side catch arms 11*a*&*b* to disengage from socket 13. Plug 10 may then be separated from socket 13.

Figure 5:
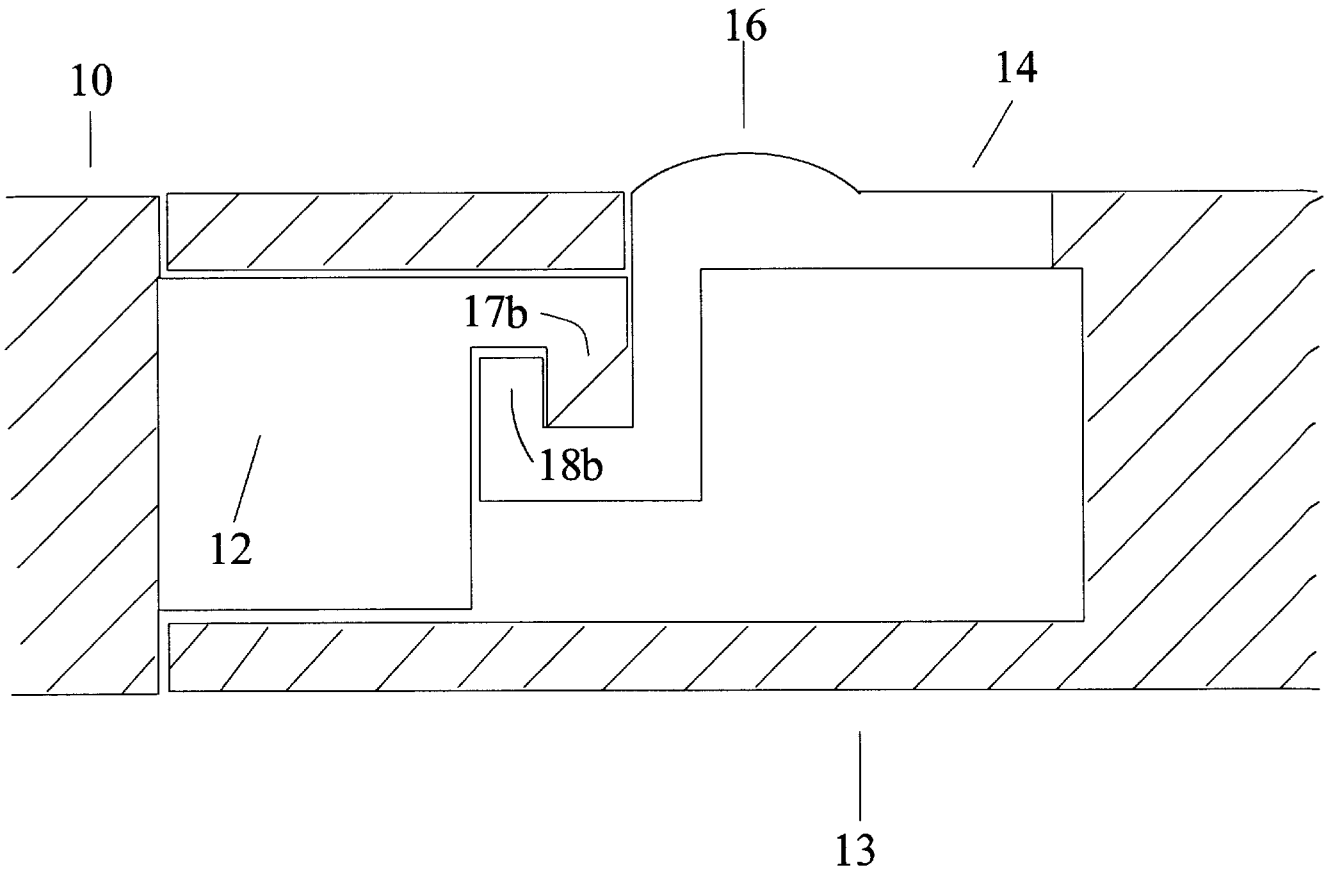
FIG. 5 illustrates an alternative embodiment, wherein the central member catch, and the depressible member catch, are of different shapes than in the main embodiment.

FIG. 5 illustrates an alternative embodiment. A catch 17*b*, having a wedge-shaped cross section, is located on the projecting end of central member 12. A catch 18*b*, having a square-shaped cross section, is located on the socket-interior end of depressible member 14. Other parts, as well as other operating steps, are the same as in the main embodiment.

Figure 6:
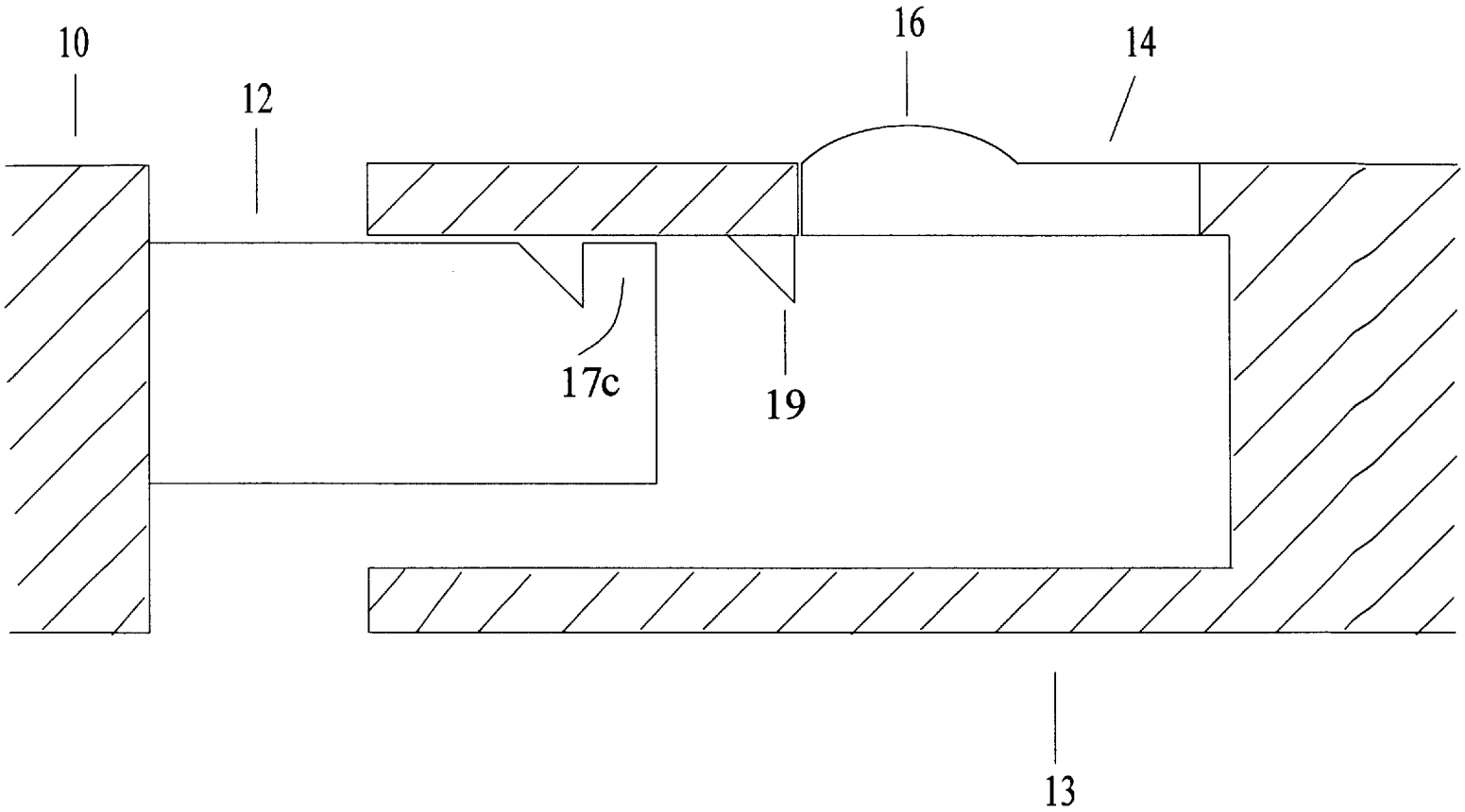
FIG. 6 illustrates an alternative embodiment—a version with different central member engagement and disengagement means.

FIG. 6 illustrates an alternative embodiment, with different central member engagement and disengagement means. In this embodiment, depressible member 14 has no catch; rather, a socket catch 19 is located on the inner front surface of socket 13. A catch 17*c*, having a square-shaped cross section, is located on the projecting end of central member 12. In the engagement process, the resiliency of central member 12 allows catch 17*c* to engage socket catch 19. In the disengagement process, depressible member 14 is depressed at button 16, thus disengaging catch 17*c* from socket catch 19. Other parts, as well as other operating steps, are the same as in the main embodiment.

Thus the reader will see that this invention is very effective at preventing the inadvertent or unwanted release of a snap buckle. Yet, the additional catch safety feature can be operated quickly and easily by an adult.

While my above description contains many specificities, these shall not be construed as limitations on the scope of the invention, but rather as exemplifications of embodiments thereof. Many other variations are possible.

A few such examples follow:

The length of the depressible member along the surface of the socket, and the corresponding length of the central member, may be different. The depressible member must be suitably long so that the resiliency of the material allows sufficient downward movement to disengage the depressible member from the central member. In addition, the widths of the depressible member and the central member may be different than those shown in the main embodiment, as long as sufficient clearance exists for the operation of the side catch arms.

The depressible member may be formed apart from the socket, and attached to the socket with a spring-action hinge, rather than integrally formed with the socket as in the main embodiment (multiple-piece construction, instead of one-piece construction). In addition, the depressible member may be located on the back surface of the socket, facing toward the object being strapped in. In the preferred embodiment, however, the depressible member is located on the front surface of the socket, facing away from the object being strapped in.

The central member and depressible member catches may have different engaging/locking action. As shown in FIG. 5, the shape of the catches may be different, provided that the catches are shaped so as to engage automatically when the male plug is inserted into the female socket, and disengage easily when the depressible member is depressed. As shown in FIG. 6, the depressible member may have no catch at all, and may merely push down on the central member to disengage the central member catch from an alternate engagement means within the socket.

The button may be of various sizes and shapes, and may be located differently on the depressible member. Also, the button may be eliminated, to make unwanted disengagement of the buckle by a small child more difficult.

The surface of the socket surrounding the depressible member, and/or the depressible member itself, may be labeled to further indicate the operating principles of the buckle. "Push", "Push Down Button", and "Push Down Button While Pushing In Side Arms" are examples of such labeling.

Finally, the buckle may have only one side catch arm, instead of two.

Accordingly, the scope of the invention should be determined not by the embodiments illustrated, but by the appended claims and their legal equivalents.

I claim:

1. A safety snap buckle, comprising:

a) a male part having catching means, and having a central member with an additional catch located thereon, and b) a female part having a depressible member located thereon, engageable with said catch, and having an open end, a front surface, and a back surface, whereby disengagement of said male part from said female part requires manual pressure on said catching means and said depressible member.

2. The device of claim 1, wherein said catching means comprise a catch arm spaced laterally apart from said central member.

3. The device of claim 1, wherein said catching means comprise two catch arms spaced laterally apart from said central member.

4. The device of claim 1, wherein said depressible member has a catch located thereon.

5. The device of claim 4, wherein said catch located on said depressible member has a wedge-shaped cross section.

6. The device of claim 4, wherein said catch located on said depressible member has a square-shaped cross section.

7. The device of claim 1, wherein said catch located on said central member has a wedge-shaped cross section.

8. The device of claim 1, wherein said catch located on said central member has a square-shaped cross section.

9. The device of claim 1, wherein a catch is located on the inner surface of said female part.

10. The device of claim 1, wherein said depressible member extends toward the open end of said female part.

11. The device of claim 1, wherein said depressible member is located on the front surface of said female part.

12. The device of claim 1, wherein said depressible member is located on the back surface of said female part.

13. The device of claim 1, wherein indicating means are located on said depressible member, thereby facilitating optimal pressure application on said depressible member.

14. The device of claim 13, wherein said indicating means consist of a button.

15. The device of claim 1, wherein said depressible member and said female part are formed together, of one-piece construction.

16. The device of claim 1, wherein said depressible member and said female part are formed apart, of multiple-piece construction.

17. The device of claim 1, wherein said male and said female part are formed from a material selected from the group comprising acetal, polypropylene, and nylon.

* * * * *